United States Patent [19]

Parker

[11] 4,222,440

[45] Sep. 16, 1980

[54] METHODS OF SMALL VOLUME PUMPING ESPECIALLY SUITED FOR OIL RECOVERY FROM STRIPPER WELLS

[75] Inventor: William H. Parker, Hurst, Tex.

[73] Assignee: Del Norte Technology, Inc., Euless, Tex.

[21] Appl. No.: 964,043

[22] Filed: Nov. 27, 1978

[51] Int. Cl.[2] ..... E21B 43/00; F04F 1/06; F04F 1/08

[52] U.S. Cl. ..... 166/314; 417/118; 166/68

[58] Field of Search ..... 166/314, 311, 105, 105.6, 166/68; 417/118, 121, 137, 145, 147, 226, 240, 349

[56] References Cited

U.S. PATENT DOCUMENTS

| | | | |
|---|---|---|---|
| 649,326 | 5/1900 | Losure | 166/68 X |
| 751,323 | 2/1904 | Moran et al. | 417/118 |
| 1,339,137 | 5/1920 | Rogers | 417/108 |
| 1,616,017 | 2/1927 | Williams | 417/118 |
| 1,798,774 | 3/1931 | Yates | 166/314 X |
| 2,768,694 | 10/1956 | Moll et al. | 166/311 X |
| 3,266,574 | 8/1966 | Gandy | 417/137 X |

FOREIGN PATENT DOCUMENTS

| | | | |
|---|---|---|---|
| 558554 | 6/1958 | Canada | 417/118 |
| 424899 | 3/1935 | United Kingdom | 417/240 |

*Primary Examiner*—Stephen J. Novosad

[57] ABSTRACT

A pair of inverted, concentrically mounted cups are lowered into a pool of liquid at the bottom of a well. The outer cup is a housing connected to atmospheric pressure via a capillary tube extending upwardly to the top of the well. The inner cup is a closed dome. Liquid passes through a check valve in the bottom of the housing and rises in the outer cup, since the capillary tube is open to the atmosphere and bleeds off the air inside the outer cup. Since the inner cup is closed, air is entrapped therein to limit the rise of liquid in it. When the capillary tube and, therefore, the two cups are pressurized, the check valve closes to prevent escape of liquid from the housing. The liquid rises in the dome to compress the air entrapped therein. When the capillary tube is suddenly opened again to atmospheric pressure, the compressed air entrapped in the closed dome of the inner cup drives the liquid violently up the capillary tube. Inertia carries a substantial amount of this liquid out the free end of the capillary tube and into a catch basin.

9 Claims, 8 Drawing Figures

METHODS OF SMALL VOLUME PUMPING ESPECIALLY SUITED FOR OIL RECOVERY FROM STRIPPER WELLS

This invention relates to small volume pumping, and more particularly—although not exclusively—to means for pumping the last few buckets full from stripper wells.

As petroleum and gas reserves become exhausted, the last small amounts of liquid remaining in a well become more valuable. Then, there are substantial economic incentives to find means for and methods of recovering these small amounts. There also are substantial humanitarian reasons for recovering these residues of fuel since all of mankind benefits from a use of energy.

On the other hand, the wells, tubing string, and other downhole equipment, are already in place. Often the downhole tubing string and other equipment have too small a diameter, so that otherwise attractive options cannot be used. Much of the tube casing is different from that used in the more modern installations. Thus, the pumps for recovering the last few buckets full of liquid should be able to work efficiently with any existing well equipment, even if it is too small, because it is too expensive to run a new well or tubing string to recover such small amounts of liquid.

This seems to suggest that a gas lifting or a gas driven pumping system might be an attractive answer to the problem. A summary of prior art concepts for such gas lifting systems is found in an article entitled "The History and Modern Application of Gas Lift", by R. H. Burke, *Journal of Petroleum Technology,* January 1952. See also, "New Gas-Lift Concept-Continuous-Flow Production Rates From Deep Low-Pressure Wells", by DeMoss, Ellis and Kingsley, *Journal of Petroleum Technology,* January 1974, page 13. Another article is "Windmills Make a Comeback", *Progressive Farmer,* July 1978, page 32.

These and similar articles show that there has been almost no change in the gas lift methods which have been used since the mid-1800s. In essence, existing techniques require two downhole tubes, one tube for pumping gas downhole, and the other tube for carrying a bubbling mixture of gas and liquid back up and out of the well to the surface. A difficulty with this gas lift method is that the height which the gas may lift the liquid is severely limited. Also, the need for two tubes prevents or severely limits the capacity of the system when used in the older, smaller diameter tubing.

Accordingly, an object of this invention is to provide new and improved means for and methods of lifting liquids from substantially exhausted oil or gas wells. Here, an object is to enable an economic recovery of bucket-sized lots of oil.

Another object of the invention is to provide oil recovery systems which may be lowered through existing tubing strings, regardless of how limiting the diameter of the tubing string may be.

Yet another object is to provide a quiet and trouble-free pumping system with virtually no moving parts.

Still another object is to provide an energy efficient pumping system which is economically operated even when almost no oil is recovered.

In keeping with an aspect of the invention, these and other objects are accomplished by a downhole pump comprising a nested pair of concentrically mounted inverted cups. A pressure operated ball valve closes the bottom of the outer cup to form a housing, into which liquid rises as air escapes up a capillary tube communicating from the top of the outer cup to the surface. Little or no liquid enters the inner cup since it is a closed dome and there is no way for entrapped air to escape therefrom. Then, air is pumped down the capillary tube to increase the pressure inside the housing and thereby force the ball valve shut to prevent the liquid from escaping. Therefore, the increased air pressure inside the housing forces the fluid to rise in the inner cup, compressing the air entrapped therein. Suddenly, valves at the top of the capillary tube are operated to switch from compression to atmospheric pressure. When this occurs, the compressed air trapped inside the dome of the inner cup forces the liquid to shoot up the capillary tube to the top of the well. Then the pump cycle repeats as the housing fills, is pressurized, and then is allowed to depressurize.

An embodiment of the invention is seen in the attached drawings, wherein.

Figure 1:
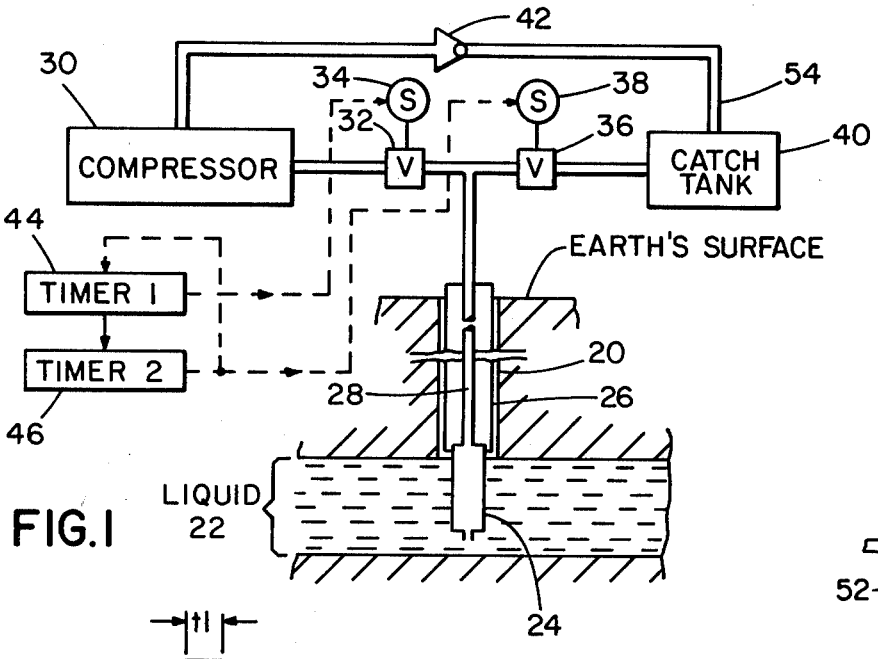
FIG. 1 is a schematic circuit diagram showing how the pumping system operates in a well, which might be a depleted oil well.

In FIG. 1, an oil well is represented at 20 as extending downwardly through the earth represented by cross-hatching. At the bottom of the well 20, there is a sump or space 22 in which liquids collect after the petroleum in the well is virtually exhausted. The downhole pump 24 is lowered through a tubing string 26 into the sump area 22. The pump 24 is connected to the surface via a capillary tube 28. Capillary tubing of this type is fine enough so that it may be wound upon and unwound from a reel, yet it is mechanically strong enough to support the pump 24 as it is lowered, suspended in a deep well, and then raised.

Above the surface of the earth, there is a compressor 30 connected to the capillary tubing 28 via a valve 32 controlled by a solenoid 34. Another connection is completed from the capillary tube via a valve 36 controlled by a solenoid 38, to a catch tank 40. The catch tank 40 is coupled back to the compressor 30 via a check valve 42. In general, the compressor 30 tends to draw air from the catch tank 40 and to feed compressed air through the valve 32 and downhole. Thus, a tank controlled by the compressor 30 contains air at high pressure, and the catch tank 40 contains air at either atmospheric pressure or less.

Figure 2:
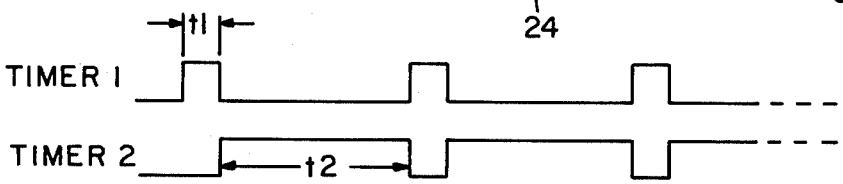
FIG. 2 is a timing diagram illustrating how the pumping system operates.

An electrical system comprises two timers 44, 46, here designated "Timer 1" and "Timer 2". The time cycle of these two timers is shown in FIG. 2. The valves 32, 36 controlled by these timers are open when the curve is high and closed when the curve is low. Thus, Timer 1 operates the solenoid 34 and opens the valve 32 during a relatively short time period (t1). When Timer 1 times out, Timer 2 is triggered to operate the solenoid 38 and open the valve 36 during a relatively long time period (t2). When either one of the valves is opened, the other is closed.

Figure 3:
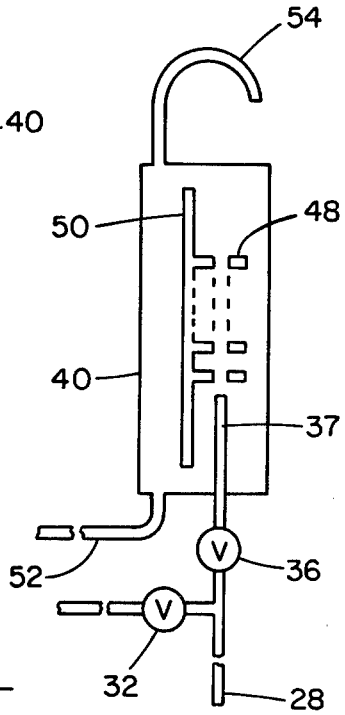
FIG. 3 is a schematic showing of a muffler and catch tank combination which shows how the noise of the system is controlled.

The catch tank or fitting 40 is located at the top of the well and connected to the capillary tube 28, as seen in FIG. 3. The capillary tube 28 runs downhole and leads to the valves 32, 36. The opposite end of the capillary tube 28 terminates in an open-ended blow line 37. It is important for the capillary tube 28 and the blow line 37 to be straight during pumping so that the tube will not be eroded by fast moving liquid. When the valve 36 is opened, the air pressure in the pump at the bottom of the capillary tube 28 causes the petroleum or other liquid to shoot up the capillary tube 28, through the valve 36, out the blow tube 37, and into the interior of the catch tank 40. Above the end of the blow line 37, there are a number of baffle plates 48 and a partition 50 separating the baffled area from the remainder of the catch tank 40. The entire mechanical structure is acoustically tuned to reduce noise. The petroleum or other liquid strikes the baffle plates 48 and the interior surfaces of the catch tank 40, and then falls under gravity to the bottom of the tank 40 where it runs off through a suitable drain 52. The compressed air which accompanies the liquid drains off through a vent 54.

Figure 4:
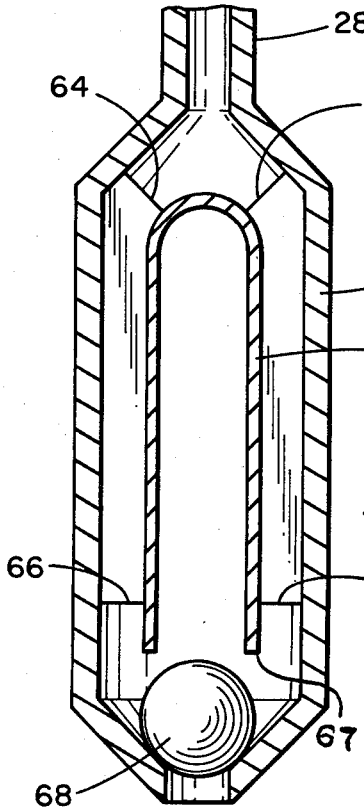
FIG. 4 is a cross section of the downhole pump.

The construction of the downhole pump is seen in FIG. 4. There are a pair of inverted, somewhat cup-shaped members 60, 62, preferably held in a nested, coaxial relationship by a supporting spider of any suitable number of rods, wires, spacers or the like, such as 64, 66. This supporting spider has no appreciable effect upon the flow of fluids (liquid or gas) into or out of the pump. The capillary tube 28 connects to and communicates through the top of the outer converted cup 60. The inner cup 62 is a closed dome having an open brim 67 on its lower edge so that there is free liquid communication between the interiors of the two cups.

Figure 5:
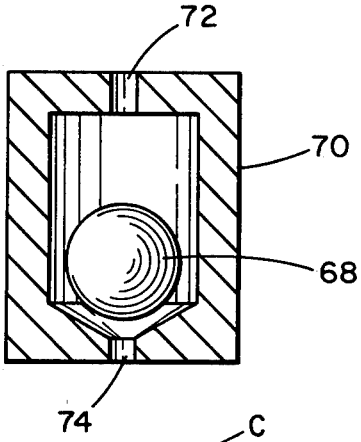
FIG. 5 is a cross section showing of a ball valve used in the bottom of the downhole pump.

A ball valve 68 rests in the bottom of the outer cup 60 to form a closed housing. This ball is shown in FIGS. 4, 6, 7 and 8 as a ball resting freely on an interior conical surface at the bottom of the outer cup 60. However, it should be understood that any suitable ball or flap valve could be used. For example, FIG. 5 shows the ball valve 68 as being captured within a suitable sleeve 70 having holes 72, 74 in the top and bottom of the sleeve. The inside bottom surface of the sleeve 70 includes a valve seat which may be closed by the ball valve 68.

When the internal housing pressure at the hole 72 exceeds the outside well pressure at the hole 74, the ball is seated and nothing significant escapes through the hole 74. When the external well pressure at the hole 74 exceeds the internal housing pressure at the hole 72, the ball valve 68 is dislodged so that petroleum or other liquid may enter the hole 74, fill the sleeve 70 and escape through the hole 72 to fill the pump housing. There is no valve seat at the top of the sleeve 70 and the ball valve 68 is fairly heavy; therefore, it does not seal the hole 72 so that liquids entering at the hole 74 flow freely into the outer inverted cup 60. For example, FIG. 5 has been drawn with the ball valve 68 dislodged by incoming liquid to enable it to flow through the sleeve 70 and into the housing cup 60.

Figure 6:
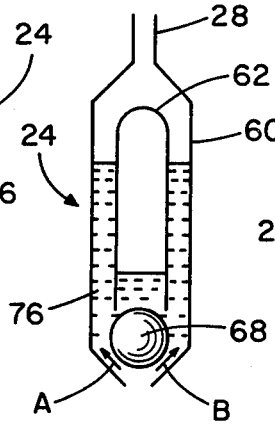
FIGS. 6, 7 and 8 are schematic showings of the three steps in a pumping cycle.
Figure 7:
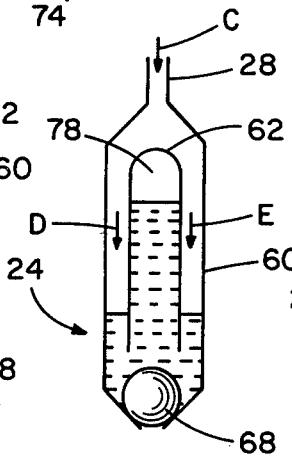
Figure 8:
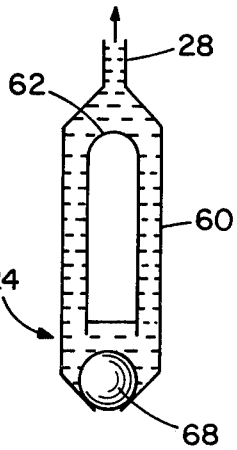

The three steps in the pumping cycle are shown in FIGS. 6, 7 and 8. First, the valve 36 (FIGS. 1 and 3) is opened so that the capillary tube 28 and, therefore, the pump 24 are open to the atmosphere. The petroleum or liquid 76 rises through the ball valve 68 and within the outer housing cup 60 (as indicated by the arrows A, B) because the pressure below the ball valve 68 is greater than the pressure above it. The liquid 76 does not significantly enter the inner cup 62 because its top is a closed dome and air is entrapped therein. This is somewhat similar to inverting a water glass and placing its open-end brim down into a pan of water. The air entrapped in the water glass keeps most of the water from entering the glass.

As shown in FIG. 7, during the time period t1 (FIG. 2), the valve 32 (FIGS. 1 and 3) opens and the high pressure of the compressor 30 is applied to the top of the capillary tube 28. Under high pressure, air is forced down the capillary tube 28 and into the outer housing cup 60, as indicated by the arrows C–E. The ball valve 68 is seated, since the internal housing pressure is greater than the external well pressure. No petroleum or other liquid can escape from the outer housing cup 60. Therefore, the pressure building inside the outer housing cup 60 forces the liquid to rise inside the inner cup 62 until the air entrapped in the dome 78 reaches a pressure that is equal to the compressor supplied pressure. Gas or air from the compressor will percolate into the dome 78 during this charging cycle.

At time t2, the valve 32 closes and the valve 36 opens. Suddenly, the pressure in the outer housing cup 60 and in the capillary tube 28 is reduced to a level which is much lower than the pressure of the air entrapped in the dome 78 in the top of the inner cup 62. The high pressure in the dome 78 rapidly expels the petroleum or other liquid which has risen inside the inner cup 62. The ball valve 68 remains seated because the pressure inside the outer housing cup 60 is greater than the outside well pressure. Therefore, as the petroleum or other liquid is expelled from the inner cup 62, there is no place for it to go except up the capillary tube 28 and into the catch tank 40. The reaction is sudden, propelled by gas in the charged dome 78, where the liquid is lifted against gravity by the high pressure in the dome 78 in a solid stream, followed by a two-phase flow of gas and remnant fluid until the system reaches pressure equilibrium.

After the pressure of the gas entrapped in the dome 78 (FIG. 7) is dissipated by the petroleum or other liquid being expelled up the capillary tube 28, the internal pressure is relieved on the top of the ball valve 68 so that it opens and returns to the state shown in FIG. 6. The time period t2 lasts long enough for the petroleum or other liquid to rise in the outer cup 60 and perhaps in the capillary tube 28 to the level of the fluid standing in the well area 22 (FIG. 1). Then the next t1 pulse appears to repeat the cycle.

Those who are skilled in the art will readily perceive how changes and modifications may be made in the disclosed structure. Therefore, the appended claims are to be construed to cover all equivalent structures falling within the scope and the spirit of the invention.

I claim:

1. A method of using an air driven pump to extract the last small amounts of liquid from a source, said method comprising the steps of:

(a) nesting a pair of inverted cups;

(b) closing the bottom of the outer of said cups through a one-way valve to form a pump housing for enabling liquid to enter at least said outer cup when the pressure outside said housing exceeds the pressure inside said housing and for preventing liquid from leaving said housing through said valve when pressure inside said housing exceeds the pressure outside said housing;

(c) selectively controlling the pressure in said housing via a passage leading through substantially the top region of said outer cup, said inner cup being a closed dome which entraps air when liquid rises in said housing; and (d) alternately pressurizing and depressurizing said housing.

2. The method of claim 1 wherein said passage is a capillary tube extending from said pump to a catch tank, and said step of pressurizing and depressurizing said housing comprises the steps of controlling valves coupled between said capillary tube and said catch tank, and applying compressed air through one of said valves to said capillary tube.

3. The method of claim 2 and the added step of cyclically opening a valve while closing another valve to alternately pressurize and relieve said pressure in said housing.

4. The method of claim 3 and the added step of cyclically operating said valves to pressurize said housing during relatively short periods of time and to depressurize said housing for a relatively long period of time.

5. A pumping method comprising the steps of:

(a) collecting liquid via a pressure responsive valve means in a first closed housing submerged in said liquid;

(b) pressurizing said housing via a single passageway to close said pressure responsive valve means and to displace said liquid while it remains entrapped within said housing; and (c) suddenly depressurizing said single passageway and said housing whereby said displaced liquid returns from said displacement with velocity and momentum which drives said liquid out of said single passageway.

6. The method of claim 5 wherein said housing includes a closed dome having an open brim on its lower edge whereby there is a fluid communication between the interiors of the housing and the closed dome, and said sudden depressurizing step includes displacing from said dome liquid which is driven into said closed dome when said housing is pressurized, thereby compressing air entrapped in said closed dome, said compressed entrapped air driving said liquid when it returns from its displacement after said housing is depressurized.

7. The method of claim 6 wherein said passageway is a capillary tube, and said step of pressurizing includes:

(a) forcing air into and releasing air from said capillary tube communicating at one end with said housing;

(b) selectively connecting the other end of said capillary tube to either a compressor or a catch tank;

(c) baffling a passageway in said catch tank positioned in front of said other end of said capillary tube; and (d) tuning said tank and baffles to quiet noise caused by escaping gas and fluid.

8. A method of recovering small quantities of oil or other liquid from depleted wells comprising the steps of:

(a) lowering a housing closed by a pressure controlled valve means down a tubing string and into areas of said well where liquid collects, said liquid entering said housing and rising to an initial position;

(b) pressurizing said housing via a closed passage through said tubing string to build a volume of compressed air behind and to displace any liquid collected in said housing away from the initial position; and (c) suddenly relieving said pressure in said closed passage to enable said displaced fluid to return from the position of its displacement toward its initial position with substantial velocity to build momentum of fluid motion up said closed passage.

9. The method of claim 8 wherein said housing includes means for both storing said pressure during step (b) and expelling said pressure during step (c), and the added step of using said displaced liquid to differentiate between the storage and expulsion of said pressure.

* * * * *

UNITED STATES PATENT AND TRADEMARK OFFICE

CERTIFICATE OF CORRECTION

PATENT NO. : 4,222,440

DATED : September 16, 1980

INVENTOR(S) : WILLIAM H. PARKER

It is certified that error appears in the above-identified patent and that said Letters Patent are hereby corrected as shown below:

Column 3, line 31, "converted" should read --inverted--;

line 33, "liquid" should read --fluid--.

Column 6, line 5, claim 7, "pressurizing includes" should read --pressurizing and depressurizing includes--.

Signed and Sealed this

Eighteenth Day of November 1980

[SEAL]

Attest:

SIDNEY A. DIAMOND

Attesting Officer

Commissioner of Patents and Trademarks